US008770794B2

(12) United States Patent
Moeck et al.

(10) Patent No.: US 8,770,794 B2
(45) Date of Patent: Jul. 8, 2014

(54) LAMP AND USE OF A LAMP

(75) Inventors: Martin Moeck, Regensburg (DE); Guenter Kirchberger, Sinzing (DE)

(73) Assignee: OSRAM Opto Semiconductors GmbH, Regensburg (DE)

( * ) Notice: Subject to any disclaimer, the term of this patent is extended or adjusted under 35 U.S.C. 154(b) by 330 days.

(21) Appl. No.: 13/057,998

(22) PCT Filed: Jul. 23, 2009

(86) PCT No.: PCT/DE2009/001037

§ 371 (c)(1),
(2), (4) Date: May 9, 2011

(87) PCT Pub. No.: WO2010/015226

PCT Pub. Date: Feb. 11, 2010

(65) Prior Publication Data

US 2012/0127722 A1 May 24, 2012

(30) Foreign Application Priority Data

Aug. 5, 2008 (DE) ..... 10 2008 036 487

(51) Int. Cl.
*F21S 4/00* (2006.01)
*F21V 21/00* (2006.01)
*F21V 29/00* (2006.01)

(52) U.S. Cl.
USPC ..... 362/249.03; 362/294; 362/373

(58) Field of Classification Search
USPC ..... 362/249.03, 294, 373
See application file for complete search history.

(56) References Cited

U.S. PATENT DOCUMENTS

| | | | | |
|---|---|---|---|---|
| 4,007,365 | A * | 2/1977 | Stempfle et al. | 362/283 |
| D434,510 | S * | 11/2000 | Lodhie | D26/2 |
| 6,220,722 | B1 | 4/2001 | Begemann | |
| 6,936,855 | B1 * | 8/2005 | Harrah | 257/88 |
| 7,347,706 | B1 | 3/2008 | Wu et al. | |
| 7,350,936 | B2 | 4/2008 | Ducharme et al. | |
| 7,631,985 | B1 * | 12/2009 | Knoble et al. | 362/225 |
| 7,637,636 | B2 * | 12/2009 | Zheng et al. | 362/294 |
| 7,972,036 | B1 * | 7/2011 | Schach et al. | 362/290 |
| 8,072,123 | B1 * | 12/2011 | Han | 313/45 |
| 8,128,258 | B2 * | 3/2012 | Lodhie | 362/249.02 |
| 8,272,762 | B2 * | 9/2012 | Maxik et al. | 362/249.02 |
| 8,314,566 | B2 * | 11/2012 | Steele et al. | 315/185 R |
| 8,322,885 | B2 * | 12/2012 | Chen et al. | 362/249.06 |
| 8,567,983 | B2 * | 10/2013 | Boyer et al. | 362/153.1 |
| 2002/0122309 | A1 | 9/2002 | Abdelhafez et al. | |
| 2003/0038291 | A1 | 2/2003 | Cao | |
| 2003/0039122 | A1 | 2/2003 | Cao | |

(Continued)

FOREIGN PATENT DOCUMENTS

| | | |
|---|---|---|
| CN | 101144593 | 3/2008 |
| DE | 10 2004 001 124 | 10/2005 |

(Continued)

*Primary Examiner* — David J Makiya
(74) *Attorney, Agent, or Firm* — Cozen O'Connor

(57) ABSTRACT

A luminous means (1) is specified, comprising a heat sink (2), which comprises a top surface (21) and a bottom surface (22), and also two sections (23), wherein the two sections (23) are arranged one above the other, and each of the sections (23) has a side surface (231) which runs transversely with respect to the top surface (21) and bottom surface (22) of the heat sink (2) and at which at least one light-emitting diode (3) is arranged.

11 Claims, 7 Drawing Sheets

(56) References Cited

U.S. PATENT DOCUMENTS

| | | | | |
|---|---|---|---|---|
| 2004/0114367 | A1* | 6/2004 | Li | 362/248 |
| 2004/0195947 | A1 | 10/2004 | Clark | |
| 2005/0207152 | A1* | 9/2005 | Maxik | 362/231 |
| 2006/0001384 | A1 | 1/2006 | Tain et al. | |
| 2006/0193130 | A1* | 8/2006 | Ishibashi | 362/227 |
| 2007/0081338 | A1 | 4/2007 | Kuan | |
| 2008/0062689 | A1* | 3/2008 | Villard | 362/250 |
| 2008/0092800 | A1 | 4/2008 | Smith et al. | |
| 2010/0033969 | A1* | 2/2010 | Hochstein et al. | 362/249.03 |

FOREIGN PATENT DOCUMENTS

| | | |
|---|---|---|
| DE | 699 36 375 | 2/2008 |
| JP | 2007-122933 | 5/2007 |
| WO | WO 2009/115095 | 9/2009 |

* cited by examiner

LAMP AND USE OF A LAMP

RELATED APPLICATIONS

This is a U.S. national stage of application No. PCT/DE2009/001037, filed on Jul. 23, 2009.

This application claims the priority of German application no. 10 2008 036 487.8 filed Aug. 5, 2008, the entire content of which is hereby incorporated by reference.

BACKGROUND OF THE INVENTION

A luminous means is specified.

The document US 2008/0092800 A1 describes a luminous means.

SUMMARY OF THE INVENTION

One object of the present invention is to provide a luminous means which can be used in a particularly versatile fashion.

To attain this and other objects, one aspect of the invention is directed to a luminous means comprising: a heat sink, which comprises a top surface and a bottom surface, and also two sections, wherein the two sections are arranged one above the other, and wherein each of the sections has a side surface which runs transversely with respect to the top surface and bottom surface of the heat sink and at which at least one light-emitting diode is arranged.

In accordance with at least one embodiment of the luminous means, the luminous means comprises a heat sink. The heat sink is a body which is formed from a highly thermally conductive material such as a metal, for example. The heat sink is provided for absorbing heat and emits said heat to its surroundings by thermal conduction and/or convection. The heat sink comprises a top surface and a bottom surface. The top surface is that surface which terminates the heat sink at the top side thereof. The bottom surface is that surface which terminates the heat sink at the underside thereof.

The luminous means can furthermore have a connection region, via which the luminous means can be mechanically fixed and can be electrically connected. In this case, the connection region can be situated at the top surface or the bottom surface of the heat sink.

Furthermore, the heat sink comprises at least two sections of the heat sink. That is to say that the heat sink is subdivided into at least two sections or regions. The sections differ at least in terms of their position in the heat sink. Furthermore, it is possible for the sections to differ from one another in terms of shape and/or size.

In accordance with at least one embodiment of the luminous means, each of the sections of the luminous means has at least one side surface. In this case, the side surfaces of the section are arranged transversely with respect to the top surface and to the bottom surface of the heat sink. That is to say that the side surface of a section spans a plane which intersects the planes in which the top surface and the bottom surface of the heat sink lie. In this case, each section can have one or a plurality of side surfaces.

The totality of all the side surfaces of all the sections of the heat sink forms the outer surface of the heat sink, which connects the top surface and the bottom surface of the heat sink to one another. The totality of the side surfaces therefore forms the lateral outer surface of the heat sink.

In accordance with at least one embodiment of the luminous means, at least one light-emitting diode is arranged at least one side surface of each section. The light-emitting diode forms a part of the light-generating element or is the light-generating element of the luminous means. The heat generated by the light-emitting diodes during operation is absorbed at the side surface of each section and distributed via the heat sink. The heat sink then emits said heat to the surroundings for example by means of thermal conduction via its bottom surface and/or by means of convection.

In accordance with at least one embodiment of the luminous means, the luminous means has a heat sink, which comprises a top surface and a bottom surface and also two sections. In this case, each of the sections has a side surface which runs transversely with respect to the top surface and bottom surface of the heat sink and at which at least one light-emitting diode is arranged.

In accordance with at least one embodiment of the luminous means, the luminous means comprises a top surface, wherein the top surface has a larger area content than the bottom surface of the luminous means. In this case, the top surface need not necessarily be a closed surface, rather it can have openings or cutouts. The area content of the top surface is then given by the area content of that area which is enclosed by an envelope or border of the top surface. In other words, the top surface has a border, and the area enclosed by the border has an area content designated as the area content of the top surface. The same applies to the bottom surface. The bottom surface also has a border or an envelope enclosing an area, the area content of which is the area content of the bottom surface. Overall, the top surface has a larger area content than the bottom surface.

By way of example, the heat sink is formed in the manner of a truncated pyramid or a truncated cone at least in places, wherein the top surface is then formed by the larger base area of the truncated pyramid or of the truncated cone.

In accordance with at least one embodiment of the luminous means, the two sections of the heat sink are arranged one above the other, wherein the section lying closer to the top surface has a larger area content of its base area than the section further away from the top surface. In other words, the section lying closer to the top surface has a larger extent than that section which lies closer to the bottom surface.

The area content of the base area of the section can be an average area content if the section is embodied for example in a truncated-pyramid-shaped fashion or in a truncated-cone-shaped fashion.

If the heat sink has more than two sections, then in accordance with at least one development of the luminous means described here, the sections in the heat sink are arranged according to their size, such that a section has an area content of its base area that is all the greater, the closer said section lies to the top surface. The size of the sections therefore increases from the bottom surface towards the top surface.

In accordance with at least one embodiment of the luminous means, the luminous means has a heat sink, which comprises a top surface and a bottom surface and also two sections, wherein the top surface has a larger area content than the bottom surface. Furthermore, the two sections are arranged one above the other and the section lying closer to the top surface has a larger area content of its base area than the section further away from the top surface. Furthermore, each of the sections has a side surface which runs transversely with respect to the top surface and bottom surface of the heat sink and at which at least one light-emitting diode is arranged.

The luminous means described here is distinguished, inter alia, by its modular construction, that is to say its subdivision into at least two sections. The sections can have different sizes. Furthermore, it is possible for the sections to differ from one another with regard to the number or the distribution of the light-emitting diodes which are applied on side surfaces of the sections. In this case, the modular construction of the luminous means makes it possible to create a luminous means which can be individually adapted with regard to the intended site of use. In other words, a luminous means is thus specified which can be used in a very versatile fashion despite its simple producibility.

In accordance with at least one embodiment of the luminous means, the heat sink has an envelope. In this case, the envelope is an imaginary boundary of the heat sink that reproduces the contour thereof. The envelope of the heat sink therefore reproduces the basic shape of the heat sink.

In accordance with at least one development of the luminous means described here, the heat sink has an envelope that is truncated-pyramid-shaped at least in places or an envelope that is truncated-cone-shaped at least in places. That is to say that the basic shape of the heat sink is, at least in places, that of a truncated pyramid or that of a truncated cone, respectively. If the envelope is embodied in a truncated-cone-shaped fashion, then the heat sink can have round, that is to say for example circular or elliptical, top and bottom surfaces.

For the case where the envelope of the heat sink is truncated-pyramid-shaped, the heat sink can have a bottom surface and a top surface which are each formed in the manner of an n-gon, where n is a natural number ≥3.

That is to say that, in the present case, "truncated-pyramid-shaped" is not restricted to a heat sink having a square base area, rather the heat sink has an n-gonal base area.

"Truncated-pyramid-shaped or truncated-cone-shaped at least in places" means that the heat sink can have sections in which it has a different shape, for example a cylinder-like or parallelepiped-like shape. Furthermore, however, it is also possible for the entire heat sink to have a truncated-pyramid-shaped or a truncated-cone-shaped envelope.

Furthermore, it is also possible for the entire heat sink to have a cylinder-like shape. Therefore, the heat sink is then shaped in the manner of a cylinder.

In accordance with at least one development of the luminous means described here, the sections of the heat sink are arranged in a staircase-like fashion. In other words, the heat sink has at least two sections, wherein the section lying closer to the top surface has a larger area content of its base area than the section further away from the top surface. The sections are arranged one on top of another in a staircase-like fashion, such that the shape of a truncated cone or of a truncated pyramid results for the envelope of the heat sink. Since the top surface has a larger area content than the bottom surface, the envelope of the heat sink is a truncated pyramid or truncated cone "turned over" relative to the "normal" orientation.

Such a shape of the heat sink is roughly modeled on the shape of a light bulb, for example. A heat sink having such a shaping can therefore be inserted into existing lighting devices such as street lamps and the like in a particularly simple way. In this way, the luminous means can be used in a particularly versatile fashion.

In accordance with at least one exemplary embodiment of the luminous means, the sections each have an n-gonal base area and comprise n side surfaces, where n is a natural number greater than 2. That is to say that each of the sections has more than two side surfaces. At least one light-emitting diode can be arranged at each of the side surfaces. The envelope of the heat sink is then embodied in a truncated-pyramid-shaped fashion, wherein the sections of the heat sink are arranged one above another in a staircase-like fashion.

In accordance with at least one embodiment of the luminous means, the sections each have a round base area. That is to say that the sections are embodied in the manner of discs or truncated cones. They have a single circumferential side surface. One or a plurality of light-emitting diodes can be fixed to the circumferential side surface. A heat sink consisting exclusively of such sections then has a truncated-cone-shaped or cylindrical envelope, wherein the sections of the heat sink can be arranged one above another in a staircase-like fashion.

In accordance with at least one embodiment of the luminous means, the heat sink has three or more sections which are geometrically similar to one another, wherein the area content of the base area of each section is all the greater, the closer the section is to the top surface of the heat sink. In other words, all the sections are then sections which each have a base area of identical shape, wherein the area content of the base area becomes smaller from section to section, the closer the section lies to the bottom surface of the heat sink.

In accordance with at least one embodiment of the luminous means, the sections of the heat sink are arranged symmetrically or substantially symmetrically with respect to a central axis of the heat sink. In this case, substantially symmetrical relates to deviations from an exact mathematical symmetry such as are caused for example by production tolerances during the production of the heat sink.

In accordance with at least one embodiment of the luminous means, the sections of the heat sink are connected to one another and, in this way, in their totality form the heat sink. In this case, it is possible for the heat sink to be embodied in one piece and for the sections merely to be imaginary regions of the heat sink by which the heat sink is subdivided into a plurality of planes in which light-emitting diodes of the luminous means are arranged. Furthermore, it is possible that the sections of the heat sink are heat sink elements which are produced separately from one another, and are connected to one another in order to form the heat sink. In this case, therefore, the sections are produced individually and subsequently connected to one another to form the heat sink. This permits particularly simple and modular production of the heat sink and thus of the luminous means.

In accordance with at least one embodiment of the luminous means, at least one side surface of at least one section is tilted at an angle of greater than 90° with respect to the bottom surface of the heat sink. Preferably, this then holds true for the side surfaces of all the sections.

In accordance with at least one embodiment of the luminous means, at least one side surface of at least one section of the heat sink is embodied as rotatable or tiltable about a rotation axis. The rotation axis runs, for example, parallel or substantially parallel to the top surface and/or bottom surface of the heat sink. That is to say that the rotation axis is not arranged transversely with respect to the bottom surface and with respect to the top surface of the heat sink, rather the rotation axis preferably intersects neither top surface nor bottom surface of the heat sink. Preferably, each side surface of each section of the heat sink is mounted such that it is rotatable about a rotation axis in this way. That is to say that different sections can have different inclinations. Therefore, light-emitting diodes which are situated on different sections also have mutually different inclinations. In this way, a predeterminable emission characteristic can be modeled particularly precisely.

In this case, the rotation axis can be a merely imaginary rotation axis, that is to say that a corresponding component need not be present in the heat sink. By way of example, the sections of the heat sink can be formed from a metal sheet. The side surfaces of the sections can then be embodied as lug-like regions of the metal sheet. On account of the flexibility of the metal sheet, said regions can be bent, which corresponds to the rotation about an imaginary rotation axis. All that is important is that an inclination of the side surface can be set in the luminous means of this exemplary embodiment. As a result, however, the emission direction of a light-emitting diode arranged at the side surface can also be set. In this way, the emission angle of the light-emitting diode arranged at the side surface can therefore be altered. This is preferably possible for all side surfaces of all sections and thus of all light-emitting diodes of the luminous means. As a result of the rotation of the side surface about the rotation axis mentioned, therefore, the emission characteristic of the luminous means can be set in a very variable manner, which results in the possibility of using the luminous means in a particularly diverse fashion.

In accordance with at least one embodiment of the luminous means, a connection carrier is applied on at least one side surface of at least one section of the heat sink, via which connection carrier a light-emitting diode arranged at the side surface can be electrically contact-connected. In this case, connection carrier is understood to mean, for example, a circuit board—including a printed circuit board (PCB). The circuit board has a base body composed of an electrically insulating material, in or on which are arranged electrical conductor tracks and connection locations for making contact with the light-emitting diode. The connection carrier can be adhesively bonded, clamped or, preferably, screwed onto the side surface. In this case, the connection carrier can accommodate one or a plurality of light-emitting diodes.

In accordance with at least one embodiment of the luminous means, at least one control device and/or at least one regulating device, by means of which the light-emitting diodes of the luminous means are energized, are arranged on the top surface of the luminous means. By way of example, the control device can be controlled the current through the light-emitting diodes of the luminous means on the basis of the measured values of a brightness sensor that detects the ambient brightness. If the surroundings darken, for example, then the light-emitting diodes can be energized by means of the control device.

Furthermore, it is possible for at least one temperature sensor that determines the operating temperature of the light-emitting diodes to be present at the heat sink. A current with which the light-emitting diodes are operated can then be regulated depending on the temperature by means of a regulating device. If the temperature increases to an impermissibly high extent, for example, then the current through the light-emitting diodes can be reduced in order to avoid overheating of the luminous means. In this case, control device and regulating device can be combined in a single microcontroller.

Furthermore, the use of a luminous means described here is specified. The luminous means described here is preferably used in a street lamp. That is to say that a conventional incandescent or discharge lamp for a street lamp is replaced by the luminous means described here. In this case, the luminous means can be fixed in the street lamp in an "upright" fashion like an incandescent bulb. Furthermore, it is possible for the luminous means to be fitted in the street lamp in a suspended fashion or horizontally.

On account of the variable emission characteristic of different embodiments of the luminous means described here, different amounts of light can be emitted in different directions, for example, by means of such a street lamp containing the luminous means. Thus, the street lamp can illuminate the course of the street particularly brightly, for example, whereas buildings are hardly illuminated or are not illuminated at all, for reasons of residents' protection. By means of the rotatable side surfaces of the sections of the heat sink it is furthermore possible to adapt the emission angle of the light generated by the luminous means depending on the location of the street lamp in which the luminous means is situated.

Such a luminous means is, in particular, also suitable for use in historical street lamps or street lamps formed according to historical models, which can be governed, in particular, by the truncated-cone-like or truncated-pyramid-like configuration of the luminous means.

Through the use of the luminous means, the light generated by the luminous means can be directed in a targeted manner. Glare effect and luminance distribution can be set in a variable manner. This is achieved, inter alia, by the heat sink consisting of sections of different sizes which are arranged in a staircase-like fashion or in a staggered fashion and which are configured with connection carriers—for example printed circuit boards—at their side surfaces.

The connection carriers are preferably embodied such that they can be screwed onto the side surfaces and can accommodate almost any desired number of light-emitting diodes, including different light-emitting diodes. As a result, it is possible to realize different light distributions and also different light colors in different spatial directions. The light distributions are adapted both horizontally to the street to be illuminated and vertically to the building that is to be illuminated or not to be illuminated, and to the antiglare projection to be achieved. The sections of the heat sink can be stacked one on top of another, as a result of which the height of the luminous means can be set in a variable manner. The sections have polygons or circles or ellipses as base area. The side surfaces of the sections can be embodied as inclinable or rotatable, such that the light-emitting diodes can emit for example horizontally, that is to say parallel to a street, downward in a manner inclined toward the street. In this case, the number of light-emitting diodes used determines the luminous flux of the luminous means, which luminous flux can be adapted to the luminous means to be replaced.

Furthermore, it is possible for the light-emitting diodes to emit upward, in a manner inclined away from the street. A building or an architectural monument can thus be illuminated, for example. Furthermore, some light-emitting diodes of a lamp can illuminate the street and other light-emitting diodes of the lamp can illuminate a building.

BRIEF DESCRIPTION OF THE DRAWINGS

The luminous means described here is explained in greater detail below on the basis of exemplary embodiments and the associated figures.

DETAILED DESCRIPTION OF THE DRAWINGS

Elements that are identical, of identical type or act identically are provided with the same reference symbols in the figures. The figures and the size relationships of the elements illustrated in the figures among one another should not be regarded as true to scale. Rather, individual elements may be illustrated with exaggerated size in order to enable better illustration and/or in order to afford a better understanding.

Figure 1A:
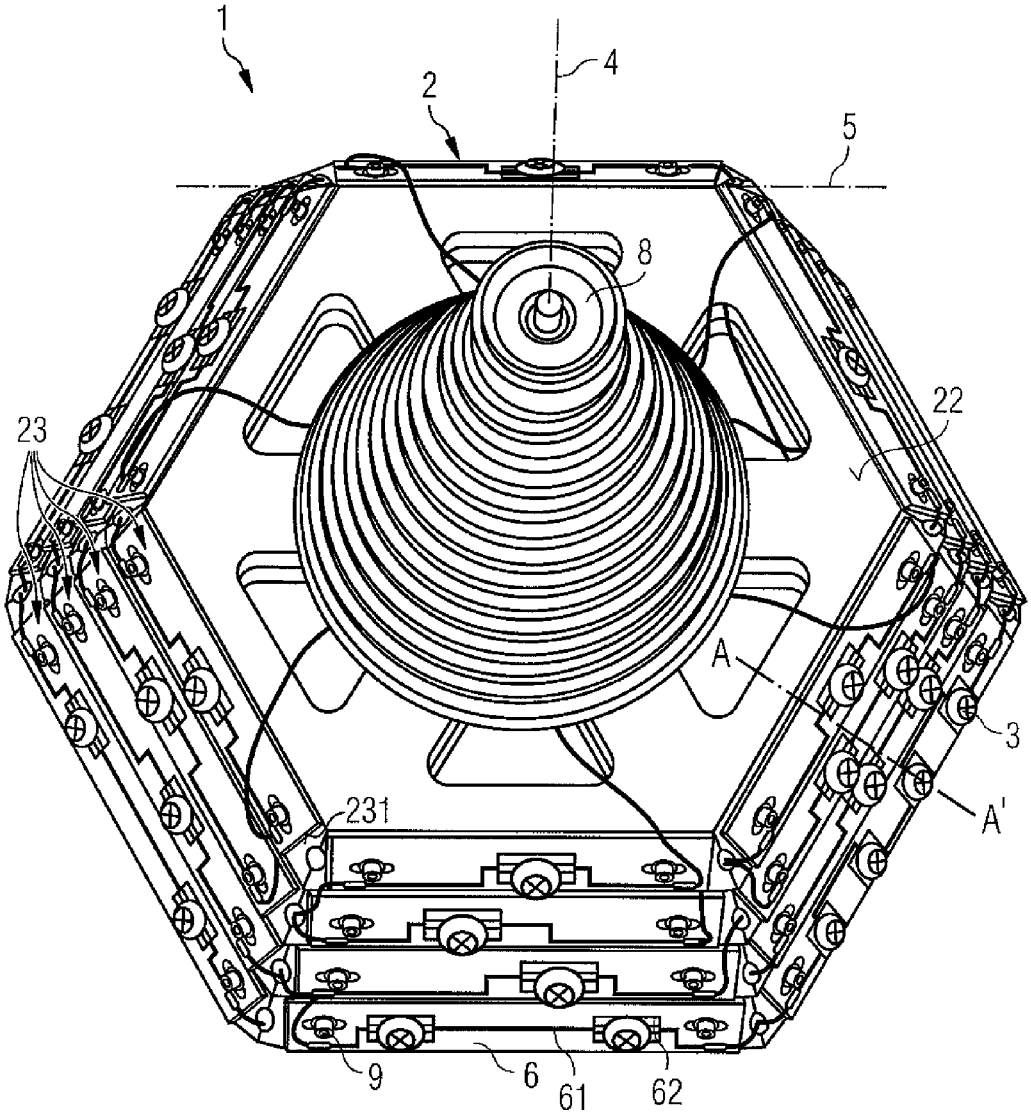
FIGS. 1A and 1B show schematic perspective illustrations of a first exemplary embodiment of a luminous means described here.
Figure 1B:
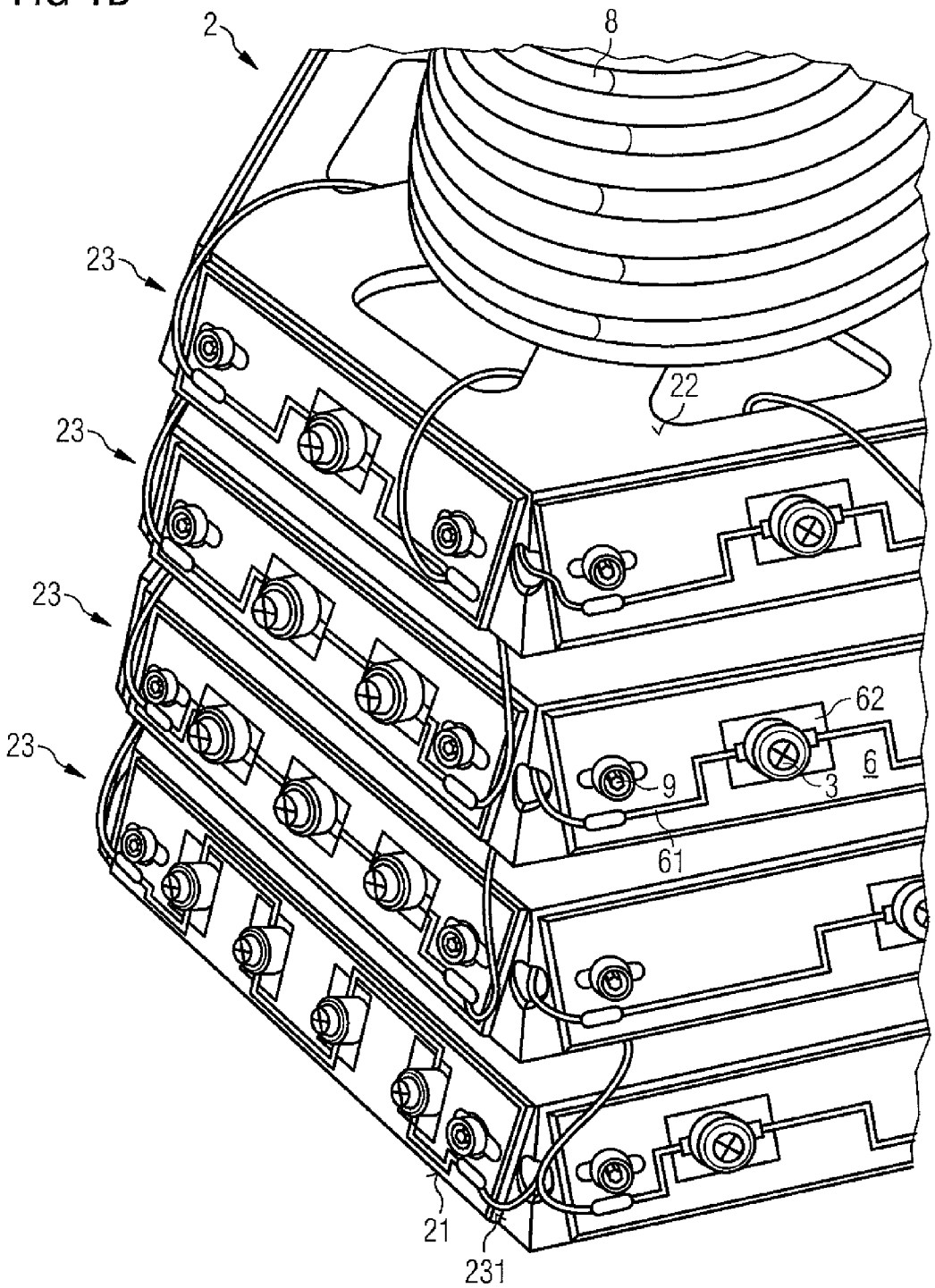

FIG. 1A shows a schematic perspective illustration of a first exemplary embodiment of a luminous means 1 described here. In this case, a view of the bottom surface 22 of the luminous means 1 is shown, said bottom surface facing away from the top surface 21 (not illustrated). FIG. 1B shows a schematic perspective illustration of the first exemplary embodiment of a luminous means 1 described here. A side view of an excerpt from the luminous means is shown in this case.

The luminous means has a heat sink 2, which is formed from a metal—for example aluminum. The heat sink 2 is composed of a total of four sections 23. Each of the sections 23 is embodied as a regular hexagon. The sections are arranged one above another, said sections being oriented symmetrically with respect to a central axis 4 of the luminous means 1. The closer a section lies to the bottom surface 22, the smaller its average area content, that is to say that the size of the sections decreases from the top surface 21 toward the bottom surface 22. The bottom surface 22 has a smaller area content than the top surface 21. In this case, the area content is formed by the content of that area which is enclosed by the hexagon at the bottom end of the heat sink 2. The area content of the top surface is determined correspondingly.

Each of the sections 23 has six side surfaces 231. A connection carrier 6 is applied to each of the side surfaces, said connection carrier being embodied as a printed circuit board in the present case. The connection carrier 6 comprises conductor tracks 61 and connection locations 62, via which light-emitting diodes 3 can be electrically contact-connected. The connection carriers 6 are connected to the respective side surfaces 231 by means of screws 9. In this case, the connection carriers 6 are constructed modularly and can be exchanged in a particularly simple manner.

Each side surface 231 is inclinable along a rotation axis 5—for example by the bending of the metal sheet from which the section 23 is formed. The emission direction of the light-emitting diode arranged on the corresponding side surface 231 can be adapted in this way.

In the present case, the sections 23 form heat sink elements which are embodied in disc-like fashion and in their totality form the heat sink 2.

At its bottom surface 22, the sink has a screw thread 8, by means of which the luminous means can be mechanically fixed and electrically contact-connected for example in a street lamp by rotation. However, the screw thread can also be arranged on the top surface 21.

Figure 2:
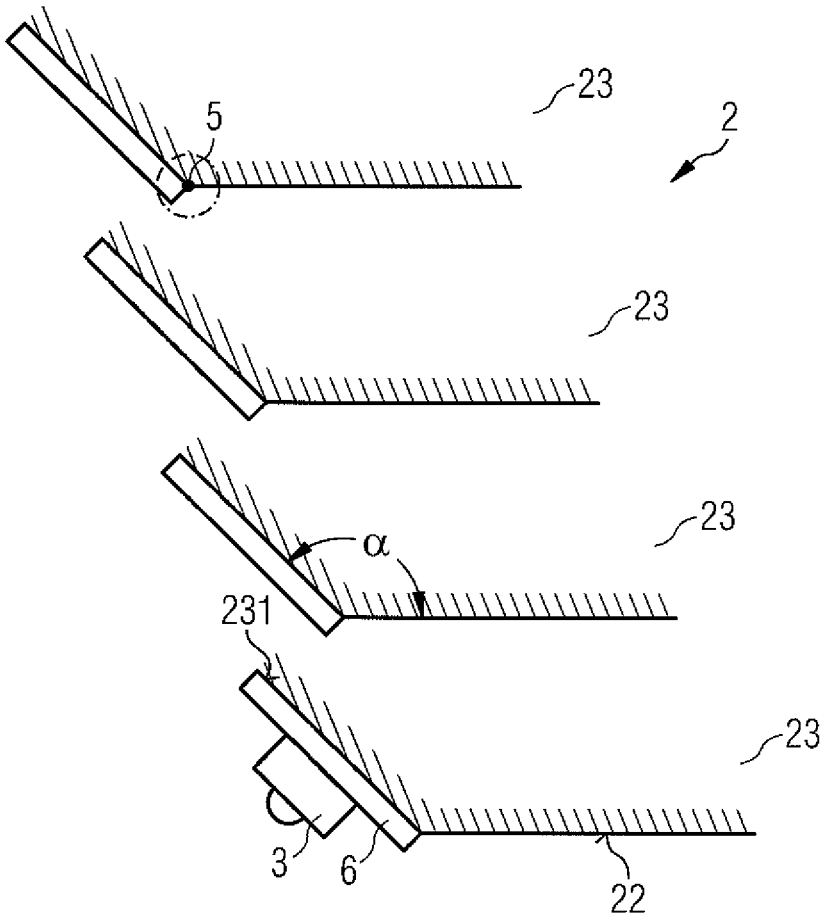
FIG. 2 shows a schematic sectional illustration of a second exemplary embodiment of a luminous means described here.

FIG. 2 shows a schematic sectional illustration through a luminous means described here, in a second exemplary embodiment. In this case, the sectional line runs for example along the line AA' as depicted in FIG. 1. The luminous means 1 comprises a heat sink 2 having four sections 23, which form heat sink elements. Each of the sections 23 has a plurality of side surfaces 231, a single side surface 231 being illustrated for each of the sections 23 in the sectional illustration in FIG. 2.

A connection carrier 6 is applied to the side surface 231 of each section, which connection carrier can accommodate at least one light-emitting diode 3. The side surface 231 forms an angle $\alpha>90°$ with the bottom surface 22, for example. The bottom surface 22 runs parallel or substantially parallel to a street if the luminous means is inserted into a street lamp.

By rotation about the rotation axis 5, the angle $\alpha$ can be altered. In this way, the emission characteristic of the luminous means can be adapted to the site of use. Furthermore, the emission characteristic can be adapted by altering the number of light-emitting diodes 3 used, and by using different-colored light-emitting diodes. By way of example, the luminous means can comprise light-emitting diodes having white emission, but also light-emitting diodes having colored emission such as blue, red or green light-emitting diodes.

Figure 3:
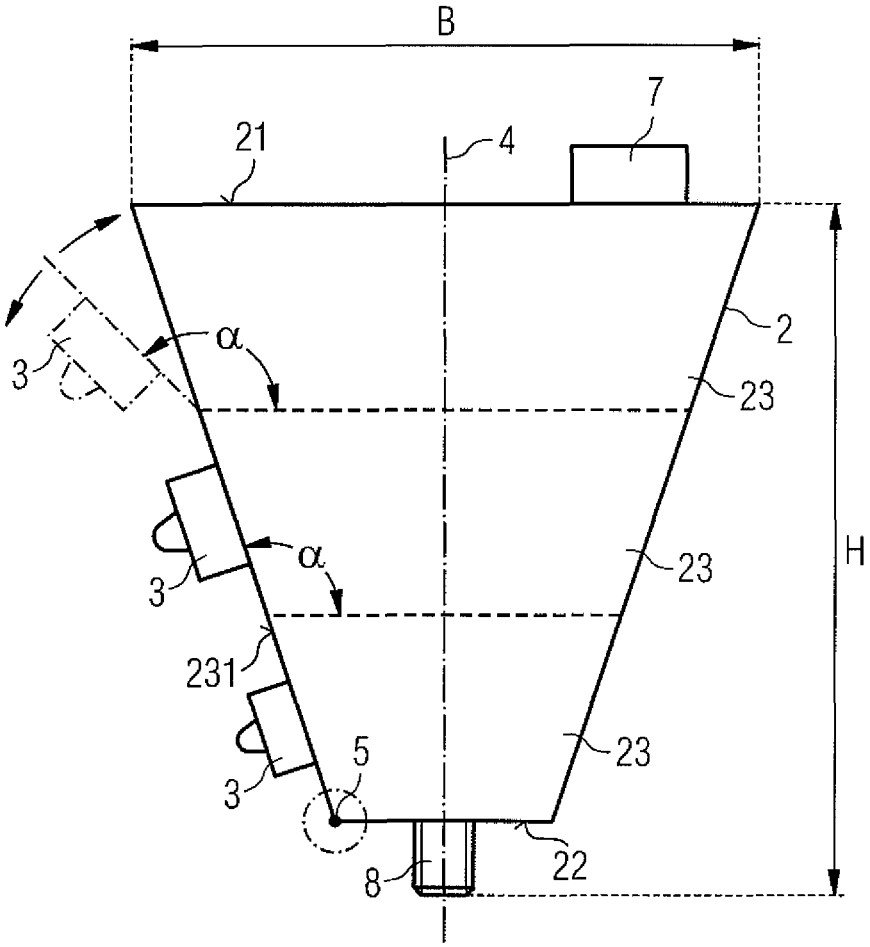
FIG. 3 shows a schematic sectional illustration of a third exemplary embodiment of a luminous means described here.

In conjunction with FIG. 3, a further exemplary embodiment of a luminous means described here is explained in greater detail on the basis of a schematic sectional illustration. In this exemplary embodiment, the heat sink 2 of the luminous means is embodied as a truncated cone. The sections 23 of the heat sink are themselves truncated cones having a circular base area. The truncated cones are arranged according to their size, such that the section having the smallest base area lies closest to the bottom surface 22 of the luminous means.

In this case, the heat sink is embodied in one piece, that is to say that the sections 23 are "imaginary sections". Light-emitting diodes 3 are applied to the side surface 231 of each section 23, wherein the side surfaces 231 can be embodied as tiltable. By way of example, the light-emitting diodes 3 are applied to a flexible circuit board 6 wound around the heat sink. The sections form different planes for the light-emitting diodes 3. A control and/or regulating device 7 is arranged on the top surface 21 of the heat sink 2, by means of which device the light emitting diodes 3 of the luminous means 1 can be energized. The luminous means 1 can be mounted into a provided mount by means of a screw thread 8.

The luminous means 1 has, for example, a height H of approximately 50 cm and a width B of approximately 25 cm. For example, approximately 70 light-emitting diodes 3 can be fixed on the heat sink 2.

FIGS. 4A to 4D show schematic sectional illustrations of further exemplary embodiments of luminous means described here. The illustration of sections 23 has been omitted in this case for reasons of clarity.

Figure 4A:
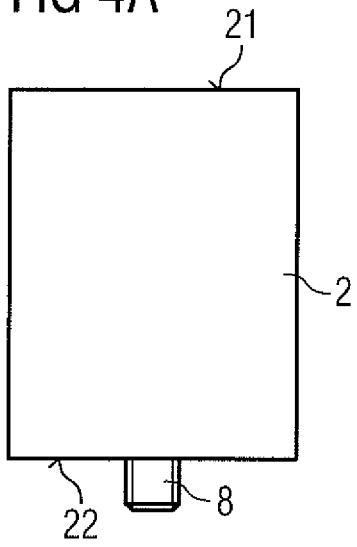
FIGS. 4A to 4D show, on the basis of schematic sectional illustrations, further exemplary embodiments of luminous means described here.

FIG. 4A shows a luminous means 1 wherein the heat sink 2 has a cylindrical envelope.

Figure 4B:
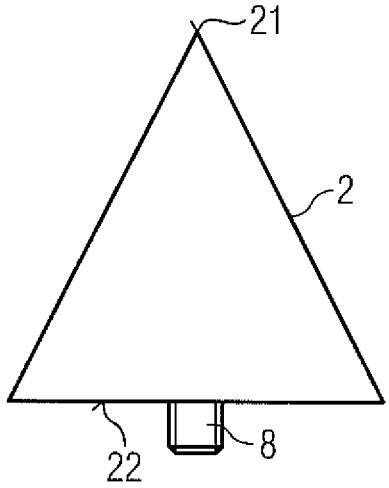

FIG. 4B shows a luminous means 1 wherein the heat sink 2 has a pyramidal envelope, the pyramid having a triangular base area.

Figure 4C:
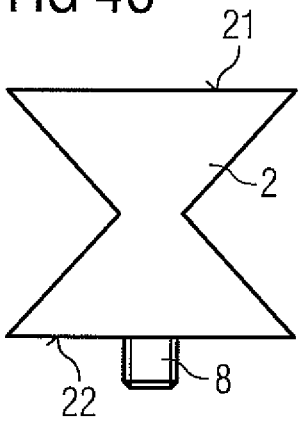

FIG. 4C shows a luminous means 1 wherein the heat sink 2 has an envelope formed from two truncated cones facing each other. Such a form is particularly well suited to illuminating "downward" for example onto a street, and "upward" for example onto a building.

Figure 4D:
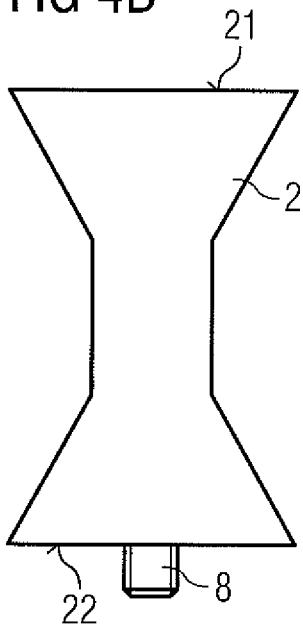

FIG. 4D shows a luminous means 1 wherein the heat sink 2 has an envelope formed from two truncated cones which face each other and which are connected to one another by a cylindrical region. Such a form is particularly well suited to illuminating "downward" for example onto a street, and "upward" for example onto a building. Light-emitting diodes at the cylindrical section of the heat sink 2 are particularly well suited to emitting horizontally.

FIGS. 5A to 5D show, with schematic plotting, possible light distributions for exemplary embodiments of luminous means described here. The darker a region appears in FIGS. 5A to 5D, the greater the illumination. By way of example, the luminous means 1 is viewed from the top surface 21. The darker a region appears in the figures, the greater there the illumination of the ground illuminated by the luminous means—for example mounted into a street lamp.

Figure 5A:
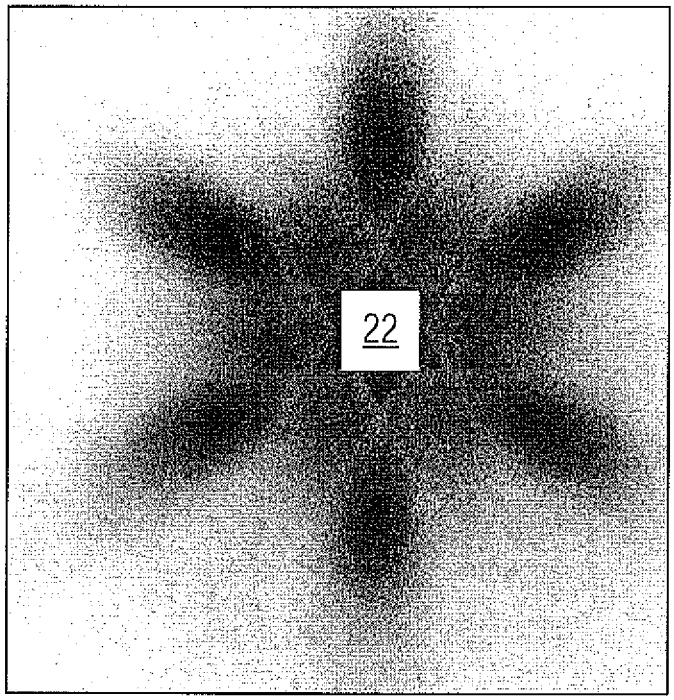
FIGS. 5A to 5D show, with schematic plotting, possible light distributions for exemplary embodiments of luminous means described here.
Figure 5B:
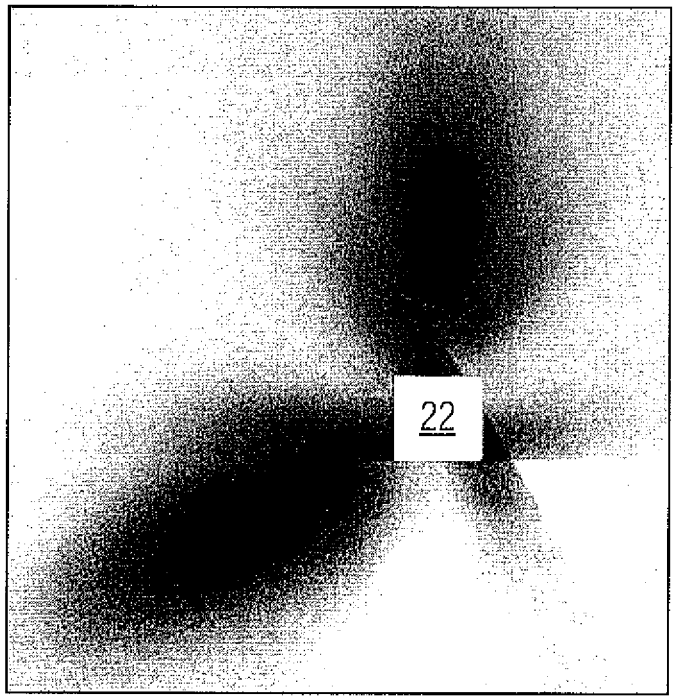
Figure 5C:
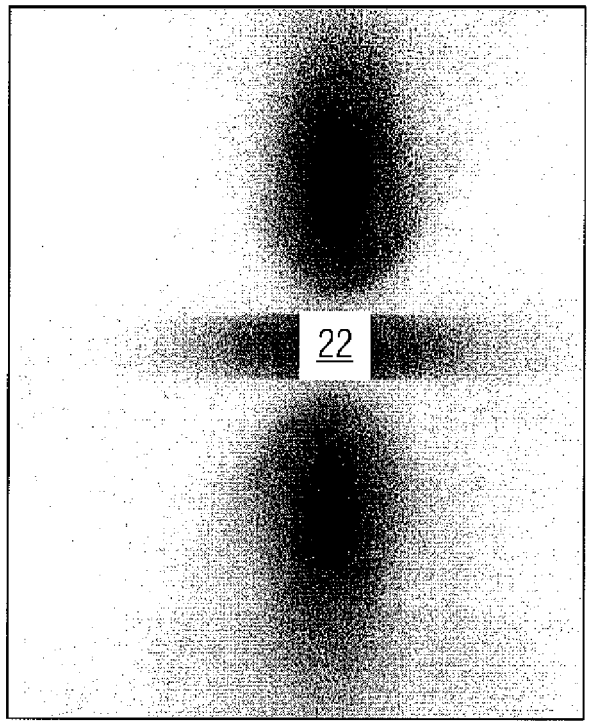
Figure 5D:
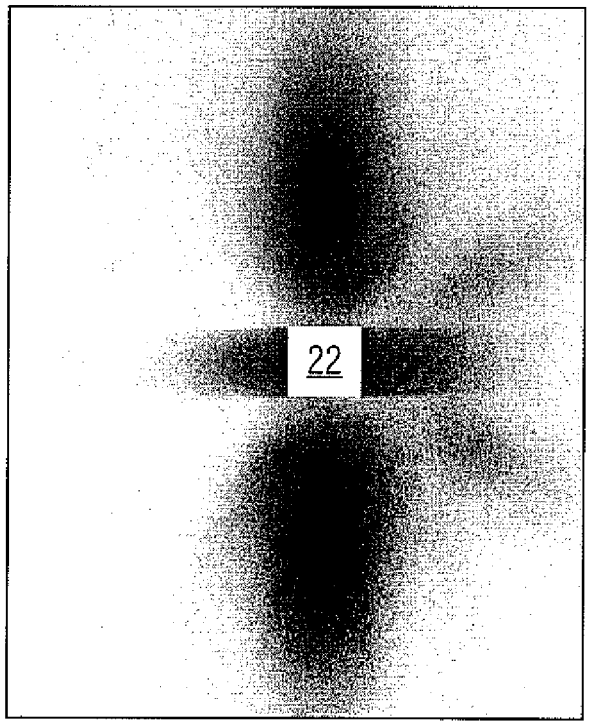

As can be seen in the figures, the illumination can be symmetrical—see, for example, FIGS. 5A and 5C—or asymmetrical—see FIGS. 5B and 5D.

Overall, with the aid of the luminous means described here, it is possible to produce different degrees of illumination in different spatial directions. The desired emission characteristic in the luminous means can be set as required in a simple manner—for example by a suitable choice of the light-emitting diodes 3 or by the inclination of the sections.

The invention is not restricted to the exemplary embodiments by the description on the basis thereof. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. A luminous means comprising:

a heat sink, which comprises a top surface and a bottom surface, and also at least two sections, wherein:

the at least two sections are arranged one above the other, each of the sections has a side surface which runs transversely with respect to the top surface and bottom surface of the heat sink and at which at least one light-emitting diode is arranged, each section of the heat sink is formed from a metal sheet, the side surfaces of the sections being embodied as lug-like regions of the metal sheet, each side surface of each section is rotatable about a rotation axis by bending of the metal sheet from which the section is formed, and each side surface of each section comprises a connection carrier applied to the side surface, via which connection carrier a light-emitting diode arranged at the side surface is electrically connected.

2. The luminous means as claimed in claim 1, wherein the top surface has a larger area content than the bottom surface, and the section lying closer to the top surface has a larger area content of its base area than the section further away from the top surface.

3. The luminous means as claimed in claim 1, comprising three or more sections which are geometrically similar to one another, wherein the area content of the base area of each section is all the greater, the closer the section is to the top surface of the heat sink.

4. The luminous means as claimed in claim 1, wherein the heat sink has a truncated-pyramid-shaped or a truncated-cone-shaped envelope at least in places and the sections of the heat sink are arranged in a staircase-like fashion.

5. The luminous means as claimed in claim 1, wherein the heat sink has a cylindrical envelope.

6. The luminous means as claimed in claim 1, wherein the sections each have an n-gonal base area and comprise n side surfaces, where n is a natural number greater than 2.

7. The luminous means as claimed in claim 1, wherein the sections each have a round base area.

8. The luminous means as claimed in claim 1, wherein the sections are arranged symmetrically or substantially symmetrically with respect to a central axis of the heat sink.

9. The luminous means as claimed in claim 1, wherein the sections are heat sink elements which are connected to one another and form the heat sink.

10. The luminous means as claimed in claim 1, wherein the rotation axis runs parallel or substantially parallel to the top surface and/or bottom surface of the heat sink.

11. The luminous means as claimed in claim 1, wherein at least one control device and/or regulating device, by means of which the light-emitting diodes of the luminous means are energized, is arranged on the top surface.

* * * * *